US005656039A

United States Patent [19]

Webster, III

[11] Patent Number: 5,656,039

[45] Date of Patent: Aug. 12, 1997

[54] ADDITIVE FOR INCREASING THE PERFORMANCE OF HYDROCARBON FUELS

[76] Inventor: Paul T. Webster, III, 8408 Lucerne Dr., Chagrin Falls, Ohio 44022

[21] Appl. No.: 389,400

[22] Filed: Feb. 16, 1995

[51] Int. Cl.[6] ..... C10L 1/00

[52] U.S. Cl. ..... 44/300; 585/14

[58] Field of Search ..... 44/300; 585/14

[56] References Cited

U.S. PATENT DOCUMENTS 3,346,354 10/1967 Kautsky et al. ..... 44/398

4,661,120 4/1987 Carr et al. ..... 44/394

5,385,588 1/1995 Brennan et al. ..... 44/331

*Primary Examiner*—Jacqueline V. Howard

*Assistant Examiner*—Cephia D. Toomer

*Attorney, Agent, or Firm*—Fay, Sharpe, Beall, Fagan, Minnich & McKee

[57] ABSTRACT

An additive for hydrocarbon fuels comprising a demulsifier, a wax dispersant, and a napthenic oil. The additive of the present invention has been found to decrease ignition times, increase power, and reduce fuel consumption, reduce emissions, and improves cold temperature flowability.

5 Claims, 1 Drawing Sheet

Fuel Cetane Test Results

ADDITIVE FOR INCREASING THE PERFORMANCE OF HYDROCARBON FUELS

BACKGROUND OF THE INVENTION

1. Field of the Invention

The invention is directed to additives which are particularly useful in hydrocarbon fuels. The additives of this invention are particularly suited for use in hydrocarbon fuels subject to fuel injection or other mechanisms to achieve atomization. Throughout the specification, numerous references will be made to the use of the additives in diesel fuels. However, it should be realized that the inventive additive can also be used in other hydrocarbon base fuels.

2. Description of the Art

In the production of hydrocarbon fuels, and in particular, diesel fuels, a variety of additives are often employed. For example, demulsifiers are supplied in additive packages such as Lubrizol® 560, 544, and 8022A to reduce the emulsification of middle distillate fuels and/or gasoline in storage tanks. In addition, wax modifiers are present in additive packages such as Lubrizol® 8069, to facilitate the dispersion of wax in hydrocarbon fuels. Fuel additives such as low temperature flow improvers, cetane improvers, dyes, antioxidants, rust inhibitors, bacteriostatic agents, gum inhibitors, metal deactivators, detergent/dispersant deposit inhibitors or cleaners, and anti-icing agents are often employed to address particular limitations of hydrocarbon fuels.

Atomization is another focus of those interested in hydrocarbon fuels. Obviously, fuel flowability and atomization are important elements to facilitate a quick, complete, and intense burn in the engine. It is believed, although not wishing to be bound by theory, that a higher degree of atomization increases the surface area of the fuel making combustion more efficient. Generally, at room temperatures and higher operating temperatures, the fuel's ability to flow and atomize is relatively good; however, lower temperatures reduce fuel flowability and atomization. In the instant invention, an additive is provided which particularly improves low temperature atomization.

It should be noted that the atomization of fuel is attacked on two primary fronts. A first focus is the mechanical means of achieving atomization, i.e. fuel injection designs. A second focus in on the chemical characteristics of the fuel, i.e. molecular attractions/repulsions which can be modified with fuel additives. Accordingly, atomization is a well studied phenomena, a fundamental description of which can be found in *Fuel Spray Technology* (SP-1026), published by The Society of Automotive Engineers, Inc. (2/94).

SUMMARY OF THE INVENTION

It is the primary object of the invention to provide a new and improved fuel additive. It is a further object of this invention to provide a new and improved fuel additive that results in improved low temperature atomization and low temperature flowability of hydrocarbon fuels. A further advantage of this invention is to provide a new and improved fuel additive that facilitates the formation of more consistent sized fuel droplets.

Additional objects and advantages of the invention will be set forth in part in the description which follows and in part will be obvious from the descriptions or may be learned by practice of the invention. The objects and advantages of the invention may be realized and attained by means of the instrumentalities and combinations particularly pointed out in the appended claims.

To achieve the foregoing objectives and in accordance with the purpose of the invention as embodied and broadly described herein, the additive of this invention is comprised of a demulsifier, a wax dispersant, a napthenic oil, and optionally an organic diluent. Preferably, the additive is comprised of between about 0.1% to 20% demulsifier, between about 1% to 60%, more preferably about 5% to 40% wax dispersant, and at least 0.1% napthenic oil, preferably at least about 5% most preferably at least about 20% (based on volume percents). In a preferred embodiment, the volume percentages of a Lubrizol® 8022A demulsifier and a Lubrizol® 8069 wax dispersant should be combined in a proportional relationship to provide 5% to 20% Lubrizol® 8022A, 20% to 60% Lubrizol®8069, and at least 0.1% napthenic oil with any remainder comprised of an organic diluent. Preferably, the additive package is utilized in diesel fuel in a ratio of one part additive to between about 700 to 2,500 parts fuel.

In a particularly preferred embodiment, about 10% of the Lubrizol® 8022A demulsifier, about 30% of the Lubrizol® 8069 wax dispersant, and about 60% napthenic oil are combined to form an additive package utilized at one part additive package to 1,000 parts fuel.

As part of the additive package including the above constituents, a variety of other known fuel additives can be included. For example, corrosion inhibitors, oxidation inhibitors, flow improvers, metal deactivators, water scavengers, emulsifiers and solvents such as aromatics and aliphatics can be included. However, the above ratios of demulsifier, wax dispersant, and napthenic oil should be maintained.

While not wishing to be bound by theory, it is believed that the above-described additive creates a modification of the fuel resulting in improved low temperature flowability and overall atomization efficiency. Particularly, it is believed that the fuel treated in with the additive of this invention has a reduced surface tension resulting in increased atomization, more consistent droplet size and superior cold temperature penetration through fuel filters. Moreover, it is believed that the inventive fuel additive causes a reduction in the surface tension of fuel which allows greater atomization of the fuel throughout the cone of the fuel injector spray.

The above theory is supported by the quantitative results achieved by treating a diesel fuel with the inventive additive. Particularly, diesel fuels treated with the additive have been found to undergo reduced smoking indicating a greater combustion of the fuel and a reduced emission of unwanted pollutants. A reduced ignition delay has also been found and an increase in power has been observed. Furthermore, fuel consumption has been reduced and overall smoother ignition, i.e. reduced engine vibration and improved engine performance have been found.

DETAILED DESCRIPTION OF THE INVENTION

Figure 1:
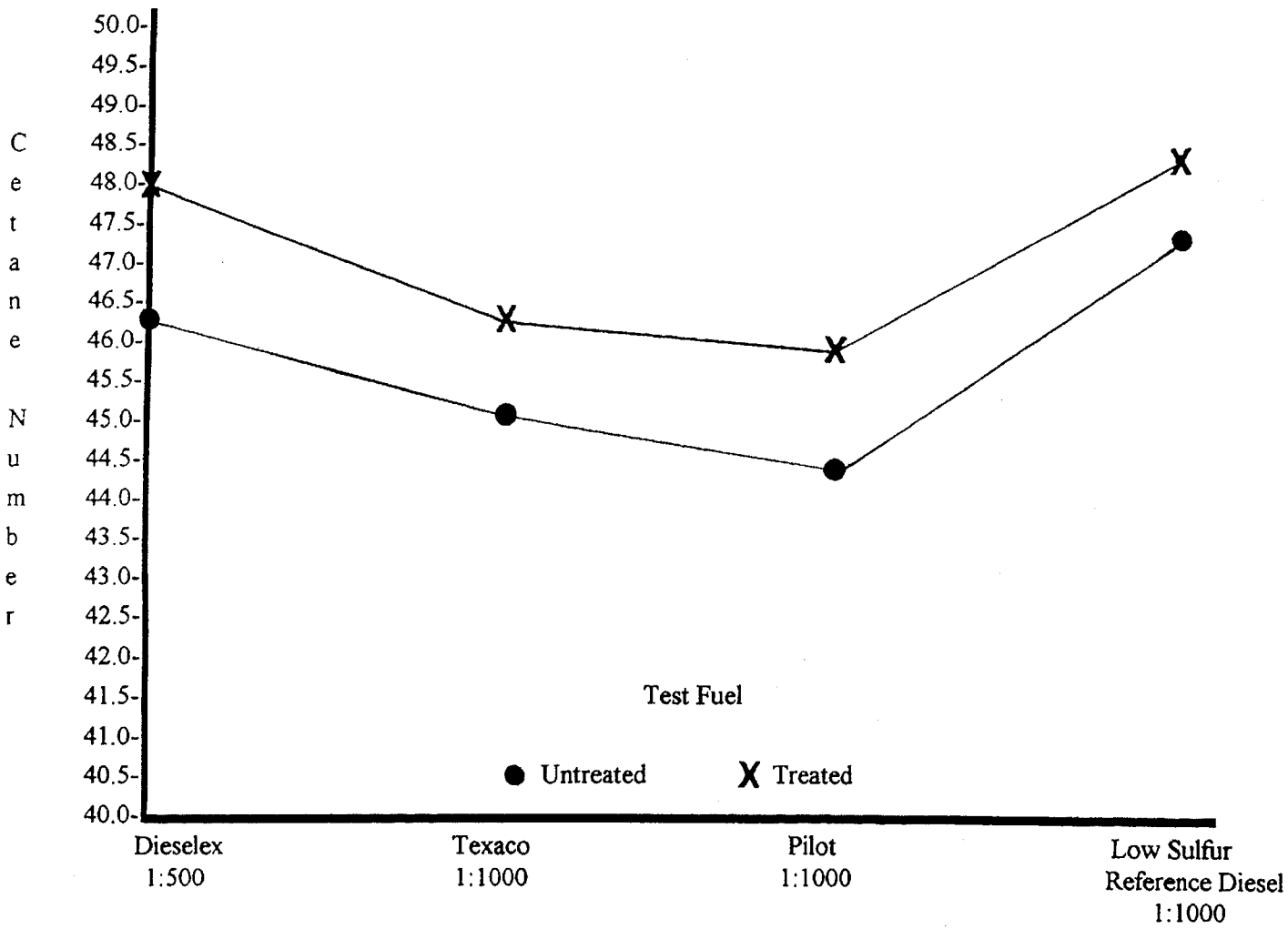
FIG. 1 is a graphical representation of cetane ratings comparing untreated fuels and fuels treated with the additive of the present invention.

While the invention will be described in connection with a preferred embodiment, it will be understood that it is not intended to limit the invention to that embodiment. On the contrary, it is intended to cover all alternatives, modifications and equivalents as may be included within the spirit and scope of the invention defined by the appended claims.

In accordance with the invention, the additive can be utilized in conjunction with any hydrocarbon fuel in which increased atomization is desired. The fuels may include liquid fuels, such as gasoline, diesel fuels, jet fuels, fuel oils, alcohols, alcohol mixtures, and distillate oils.

The demulsifier, often referred to as a detergent or dispersant in the art, of the present invention may be any of those known to those skilled in the art. Polyamine or alkanolamide derivatives are suitable examples. Polymeric dispersants are particularly preferred. Such additives have been described as useful lubricating formulations and as viscosity index improvers with dispersant characteristics. The polymeric dispersants are generally polymers or copolymers having a long carbon chain and containing polar compounds to import their dispersancy characteristics. Polar groups such as amines, amides, imines, imides, hydroxyl, ethers may be included. Specific polymeric dispersants may include copolymers of methacrylates or acrylates containing additional polar groups, ethylene-propylene copolymers containing polar groups or vinyl acetatefumaric acid ester copolymers. Nitrogen containing copolymers may also be suitable. A number of suitable demulsifiers/dispersants are described in U.S. Pat. No. 4,781,730, herein incorporated by reference. In a preferred embodiment, the demulsifier of the present invention is derived from Lubrizol® 8022A diesel fuel additive.

The wax dispersant component of the inventive additive can be an organic ester or any other material known to those skilled in the art. A particularly preferred source of the wax dispersant is the Lubrizol® 8069 diesel fuel additive.

The inventive additive package will also include napthenic oils such as mineral oils and aromatic napthas. Particularly preferred is a napthenic oil such as pale oil. A satisfactory pale oil can be obtained from Cross Oil, Smackover, Okla. However, other organic liquid diluents such as aliphatic and aromatic hydrocarbons including kerosene, textile spirits, benzene, toluene, xylene, alcohols, ethers, synthetic oils and the like may also form a portion of the inventive additive package.

The fuel compositions of this invention can contain in addition to the components of this invention, other additives which are well known to those skilled in the art. These can include anti-knock agents such as tetraalkyl lead compounds, lead scavengers such as haloalkanes (example ethylene dichloride and ethylene dibromide), deposit preventers or modifiers such as triaryl phosphates, dyes cetane improvers, antioxidants, rust inhibitors such as alkylated succinic acids and anhydrides, bacteriostatic agents, gum inhibitors, metal deactivators, upper cylinder lubricants, anti-icing agents and the like. In addition, in certain applications the composition of the present invention can include an ash dispersant. Such ashless dispersants are preferably esters of mono or polyol and a higher molecular weight mono or polycarboxylic acid acrylating agent containing at least 30 carbon atoms.

The following examples are provided to illustrate the increased power, efficiency, and fuel economy achieved with fuels containing the additive package of the present invention. It is emphasized that these examples are provided for illustrative purposes only and are not to serve as a limitation on the scope of the invention, because such scope is set out solely in the claims.

IGNITION CHARACTERISTICS

Diesel fuels are typically tested to determine their specific ignition delay characteristics in an ASTM engine cetane test procedure. FIG. 1 graphically demonstrates the cetane rating improvements provided by the addition of the inventive additive package. The results of FIG. 1 were specifically obtained with an additive package formulated with 15% Lubrizol® 8022A, 30% Lubrizol® 8069 (each of which can be obtained from the Lubrizol® Corp., 29400 Lakeland Blvd., Wickliffe, Ohio, U.S.A.) and 55% napthenic pale oil obtained from Cross Oil of Smackover, Okla. As FIG. 1 shows, four #2 diesel fuels (Dieselex, Texaco, Pilot, and Low Reference Diesel Fuel) were each tested for their cetane rating. A comparison test was then performed on each of these fuels treated with the inventive additive package identified above. The additive package was utilized at a varying treat rate between one part additive to 500 parts diesel fuel in the Dieselex and one part additive in 1,000 parts diesel fuel in the Texaco, Pilot, and Low Reference Diesel Fuel. The comparison of treated to untreated results shows a clear improvement in cetane rating between treated and untreated fuels believed to result by increasing the fuel's combustion efficiency.

HORSEPOWER ANALYSIS

A Mobil diesel fuel treated with the same additive package used in the cetane tests was evaluated for horsepower. An initial dynamometer run without additive produced an engine horsepower reading of 295 at a ¾ engine rpm of 1675. After treating the same fuel with the additive package at a rate of 0.25 ounces per gallon, the same dynamometer test was run and an increase in horsepower to 318 at 1675 rpm was demonstrated. This equates to a 7.8% increase in horsepower at ¾ speed. The results showed a positive horsepower gain at all aspects of the dynamometer run on the engine which was a 773 Caterpillar® for an off-road dump truck. The specific fuel used was an on-road low sulfur fuel with approximately a 50% kerosene cut.

EFFICIENCY

A comparative emission evaluation was performed by Engineering Test Services, 4500 Leeds Avenue, Charleston, S.C., U.S.A. A comparative test utilizing untreated low sulfur reference diesel fuel versus the same diesel fuel treated at a rate of one part per thousand of 15% Lubrizol® 8022A, 30% Lubrizol® 8069, and 55% pale oil was evaluated in an EPA certifiable transient emission test in a rebuilt 1988 LTA-10 Cummins engine. The comparative results between the untreated and treated test showed that the additive reduced carbon monoxide emissions by approximately 12% and particulate emission by approximately 4%.

The Chardon School system in Cleveland, Ohio, performed a comparative fuel economy test between their untreated diesel fuel and the same fuel treated with one part per thousand of the inventive additive combination of 15% Lubrizol® 8022A, 30% Lubrizol® 8069, and 55% napthenic pale oil. Fuel economy differences recorded over a 90 day period in five buses that first used the untreated fuel and then went to the treated fuel. These trials demonstrated an 8% to 15% fuel savings after the inventive additive combination was added to the fuel.

COLD TEMPERATURE FLOWABILITY

Basic Fuel Service, Inc. of Dover, N.J., performed low temperature filter plugging evaluations utilizing a Mobil base fuel with approximately 10% kerosene. The fuel originally demonstrated a low temperature filter plugging point of 1.4° F. This fuel was then treated at a rate of one part (30% Lubrizol® 8069 and 70% xylene) per 1,000 parts fuel with a resulting low temperature filter plugging point of −2.2° F. The Mobil base fuel was then treated with one part (15% Lubrizol® 8022A, 30% Lubrizol® 8069, and 55% napthenic pale oil) per one thousand parts fuel, a resulting −5.5 low temperature filter plugging point resulted. This test shows that the inventive additive package significantly reduces the cold temperature flowability of the fuel.

Having thus described the invention, it is claimed:

1. A fuel additive comprising about 0.1 to about 20% demulsifier, about 1 to about 60% wax dispersant and at least about 5% naphthenic oil.

2. The additive of claim 1 further comprising about 10 to about 20% demulsifier, about 5 to about 40% wax dispersant, and at least about 5% naphthenic oil.

3. The additive of claim 2 further comprised of at least about 20% naphthenic oil.

4. The additive of claim 3 wherein said naphthenic oil comprises a pale oil.

5. A fuel additive consisting essentially of a demulsifier, a wax dispersant and a naphthenic oil.

* * * * *